United States Patent [19]

Miyama et al.

[11] 4,288,287

[45] Sep. 8, 1981

[54] PHOTOGRAPHIC SUPPORT

[75] Inventors: Masao Miyama; You Kusama, both of Tokyo, Japan

[73] Assignee: Mitsubishi Paper Mills, Ltd., Tokyo, Japan

[21] Appl. No.: 111,297

[22] Filed: Jan. 11, 1980

[30] Foreign Application Priority Data

Jan. 16, 1979 [JP] Japan ..... 54-3572
Jan. 20, 1979 [JP] Japan ..... 54-5690

[51] Int. Cl.[3] ..... D21H 1/34

[52] U.S. Cl. ..... 162/135; 162/158; 162/175; 162/178; 162/179; 428/513; 430/536; 430/538

[58] Field of Search ..... 162/135, 146, 158, 164 R, 162/164 EP, 168 NA, 179, 178, 175; 430/538, 536; 428/511, 513; 525/240

[56] References Cited

U.S. PATENT DOCUMENTS 3,096,231 7/1963 Griggs et al. ..... 430/538
3,592,731 7/1971 Griggs ..... 430/538
3,630,830 12/1971 Herdle ..... 162/135
4,110,155 8/1978 Minagawa et al. ..... 162/135
4,188,220 2/1980 Kasoga et al. ..... 428/513

FOREIGN PATENT DOCUMENTS 693589 9/1964 Canada ..... 162/146
45-14121 5/1970 Japan ..... 162/146

*Primary Examiner*—William F. Smith
*Attorney, Agent, or Firm*—Cushman, Darby & Cushman

[57] ABSTRACT

A photographic support comprises a paper coated on both sides with polyethylene resin film. For providing improved cutting property of the paper when it is used for a photographic paper and subjected to an automatic printer/cutter, strength reinforcing and sizing agents contained in the support are made such that amount ratio of the former to the latter is at least 1.8. To impart the paper a desirable stiffness and further improved cutting property, polyvinyl alcohol fibers which are neither heat-treated nor acetalized, in 5–25 parts by weight, are mixed to 100 parts by weight of woodpulp fibers when the paper is formed. This allows to make the paper as light as 160 g/m$^2$ or less but having stiffness property pertaining to photographic papers.

4 Claims, No Drawings

PHOTOGRAPHIC SUPPORT

BACKGROUND OF THE INVENTION

This invention relates to photographic paper supports and more particularly to photographic paper supports having polyethylene resin layers on both sides.

The photographic support rolls are coated with photographic emulsion to be made into photographic paper rolls, which in turn are printed, developed, and finally cut into sheets of a predetermined size. Said cutting step is automated and this automatic cutting step has to be facilitated by perforating a hole or putting a mark on the photographic paper surface at a preceding step so that exact cutting positions are established. Hitherto, because of poor cutting property of the supports at the perforating and cutting steps, there often occur such problems as irregular cut edges, generation of paper dusts, in an extreme case incomplete cutting or hanging of waste debris onto the cut paper sheet and in the worst case unseparation of the paper sheets. Furthermore, in the case of providing a hole of about 0.5–1 mm as a cutting mark, the hole is filled up with trailing or whiskering of fibers or polyethylene resins of the support thus cannot be detected by a photocell resulting in the incomplete cutting or miss cutting very often. One way to solve this trouble is to always maintain the cutting or the perforating knife sharp. In order to do so, sharpness of the knives have to be checked constantly and the knife blades be changed frequently. This knife maintenance is hard and cumbersome, necessitates frequent shutdowns for knife change, therefore lowers productivity and increases costs. Therefore, such photographic supports of improved cutting property that would assure longer span of the knife repairs have been much demanded.

Furthermore, a light weight photographic polyethylene coated paper has been desired for convenience of handling and for reduction of freights, postages and costs for woodpulps and other materials. However, there is a problem that the lighter the photographic support papers are made to, the less stiff they become.

It is necessary for obtaining photographic polyethylene coated papers having good cutting properties at the cutting and perforating steps to reduce long fiber furnish as far as possible. However, hitherto, production of light weight photographic support papers having stiffness as high as that of ordinary weight papers requires furnish of long and strong woodpulp fibers such as softwood bleached kraft pulp (NBKP) or softwood bleached sulfite pulp (NBSP).

Trailing or whiskering of fibers at cut edges of supports occurs more or less regardless of length of fibers contained in the supports, but there is a tendency that longer the fibers, the more it occurs. Especially, light weight resin coated papers having, for example, a basis weight of less than 160 g/m$^2$, especially less than 150 g/m$^2$ are required to have increased stiffness and for this purpose it is preferred to use long and strong fibers in a large amount. Thus, it is earnestly desired to reduce formation of trailing or whiskering of fibers at cut edges.

The inventors, as a result of intensive researches on the improvement of supports, have found photographic supports which have extremely improved cutting properties at perforating or cutting steps.

SUMMARY OF THE INVENTION

It is an object of this invention to provide photographic resin coated supports which have good cutting and perforating properties and develop no troubles when cut by automatic cutters.

It is another object of this invention to provide light weight photographic supports of less than 160 g/m$^2$, especially less than 150 g/m$^2$, which have good cutting and perforating property, i.e., to cause formation of little trailing or whiskering of fibers at cut edges and have sufficient stiffness.

According to this invention there is provided an improved photographic support comprising a paper containing a sizing agent and a strength reinforcing agent, and polyethylene resin layer coated on both sides, the improvements wherein the amount of said strength reinforcing agent is 1.8 to 4 times that of said sizing agent and, if necessary, polyvinyl alcohol fibers are contained in the paper.

DETAILED DESCRIPTION OF THE INVENTION

The strength reinforcing agent herein used means an interfiber bonding agent which has an action of reducing interfibers slippage upon cutting of photographic papers. Examples of the strength reinforcing agent are; polyacrylamide, starch, modified starch, polyvinyl alcohol, melamine-formaldehyde resin, urea-formaldehyde resin, polyamide-epichlorohydrin, gums, etc. which are generally used in the paper industry. Among them, polyacrylamide is especially preferred in this invention.

Generally, these strength reinforcing agents have been used in an amount of 0.5–1.6% by weight of woodpulp fibers and in an amount of up to 1.5 times that of sizing agent used in combination. In this invention, the amount of the former is increased to the range of 1.8–4 times, preferably 1.9–3.5 times, more preferably 2.1–3.0 times that of the latter.

The sizing agents used in this invention are those ordinarily used and they include alkylketone dimers, rosin sizing agents, wax sizing agents, asphalt emulsion sizing agents, synthetic high polymer sizing agents, alkali metal salts of fatty acids of 14–20 total carbon atoms and combinations thereof. Alkylketene dimers and alkali metal salts of fatty acids of 14–20 carbon atoms are preferred. The fatty acids may be saturated or unsaturated fatty acids. The fatty acids having 14–20 total carbon atoms are, e.g., palmitic acid, stearic acid, oleic acid, etc. and those having 16–18 total carbon atoms are especially preferred. Among them, stearic acid salts, especially sodium stearate, are preferred.

The less the amount of the sizing agent is, the more the cutting property is improved, but on the other hand the higher a degree of edge stain that is caused by penetration of chemicals such as developing solution into polyethylene resin coated papers from their edges will result. Therefore, there is limitations within which addition of the sizing agent must be controlled. The amount of the sizing agent is at least 0.2%, preferably 0.3–1.0% by weight of woodpulp fibers.

Combination of an alkylketene dimer as the sizing agent with a polyacrylamide as the strength reinforcing agent or that of an alkali metal salt of fatty acid of 14–20, preferably 16–18 total carbon atoms, e.g., sodium stearate as the sizing agent with polyacrylamide as the strength reinforcing agent are especially effective.

Content of low-density polyethylene in polyethylene resin coated on the paper, especially on the side (hereinafter called back side) opposite to the side (hereinafter called emulsion side) on which emulsions are applied is preferably 35–80% by weight, preferably 40–70% by weight. Polyethylene resin of such composition can minimize the formation of trailing or whiskering of the resin at cut edges. Since the polyethylene layer on the emulsion side is coated with emulsions, formation of trailing or whiskering of polyethylene resin on this side is less than on the back side. Therefore, content of low-density polyethylene in the polyethylene layer on the emulsion side is not necessarily within the range mentioned above for decreasing formation of the trailing or whiskering of the resin at cut edges. The low-density polyethylenes herein used are those having a density of 0.910–0.925 and high-density polyethylenes are those having a density of at least 0.96. That is, it has been confirmed that when a polyethylene resin containing 35–80% by weight, preferably 40–70% by weight of low-density polyethylene, is coated on both sides or at least on the back side of the paper, formation of trailing or whiskering of polyethylene resin decreases.

The woodpulp used in this invention includes softwood bleached sulfate pulp (NBSP), hardwood bleached sulfite pulp (LBSP), softwood bleached kraft pulp (NBKP), hardwood bleached kraft pulp (LBKP), etc., but there is substantially no limitation regarding their kinds.

In order to conspicuously reduce the formation of trailing or whiskering of woodpulp fibers, it is effective to use woodpulp fibers of such fiber length fractionation characteristics that 0% is retained by the first wire sieve cloth having a sieve opening of 710 μm and not more than 35% of the fibers are retained by the second wire sieve cloth having a sieve opening of 350 μm in accordance with the fractionation method specified in JISP8207. Such woodpulp fibers can be easily obtained by adjusting the degree of beating. A photographic support paper having basis weight of 170 g/m$^2$ or higher naturally develops sufficient stiffness, therefore requires little concern about it. For such a paper, reduction of the trailing or whiskering of fibers at cut edges is the main point to place emphasis on. To this purpose it is only necessary to use woodpulp having aforesaid fractionation characteristic.

Formation of trailing or whiskering of pulp fibers can be further reduced by adding to the woodpulp fibers polyvinyl alcohol fibers which are neither acetalized nor heat-treated, and the paper thus formed is in turn heat-treated at a temperature of at least 50° C. This method is especially effective for light weight photographic support papers having a basis weight of, for example, less than 160 g/m$^2$, further as light as 150 g/m$^2$, to have improved stiffness, since such light weight papers need to use long fibers in order to develop stiffness.

The polyvinyl alcohol fiber furnish in the paper is at least 5%, preferably 8–15% by oven-dry weight based on the woodpulp fibers. When the furnish is less than 5%, no substantial increase in stiffness is obtainable for the light weight photographic support. On the other hand, when the furnish is increased to more than 25%, the paper web being formed come to stick to a cylinder dryer.

Moreover, when long woodpulp fiber furnish is increased in order to make up for decrease in stiffness of light weight papers, trailing or whiskering of the fibers at cut edges tends to become prevailing. Addition of the polyvinyl alcohol fibers is the right correction to impart stiffness of the light weight papers without aggravating trailing or whiskering of the fibers at cut edges, but its effect is not remarkable unless the polyvinyl alcohol fiber furnish is 5% or more.

Polyvinyl alcohol fibers used in this invention are those not heat-treated after spinning (or those slightly heat-treated may be used), those not acetalized, and those cut to 1–6 mm. The fibers swell and disperse well in water at room temperature, are corruptible, therefore have good paper-making property. Fineness and length of the fibers are not critical as long as they can be practically used. Ordinarily, their fineness is 0.5–2 denier and length 1–6 mm.

Paper made from a furnish containing aforesaid polyvinyl alcohol fibers is usually heat-treated at 50°–100° C. as it is dried at dryer part of a paper machine. The polyvinyl alcohol fibers may melt during drying, but it is important that only surface portions of the polyvinyl alcohol fibers be melted to bond with woodpulp fibers. It is not preferred to raise the dryer temperature to higher than necessary. Preferred temperature conditions are such that fibrous shape of most of said polyvinyl alcohol fibers is reserved. Thus heat-treated paper is coated with polyethylene resin on both sides as mentioned before to obtain the photographic polyethylene coated paper.

As compared with a photographic support paper which is not furnished with the aforesaid polyvinyl alcohol fibers, the paper thus obtained has better cutting or perforating property, that is, produces little dust or does not cause such troubles as hanging of waste debris onto the cut sheet, and thus incomplete cutting can be prevented at cutting step. Also, the photographic support paper of this invention does not develop trailing or whiskering of fibers at edges of holes which are perforated by a cutting mark puncher so that the miscut troubles caused by unsuccessful detection of the cutting mark by a photocell can be avoided.

In addition, as compared with a paper which does not employ the aforesaid polyvinyl alcohol fibers, the photographic polyethylene coated papers of this invention have remarkably high stiffness. This is particularly advantageous for producing light weight papers.

The photographic supports of this invention have good cutting property at cutting and perforating steps as compared with conventional photographic supports.

The photographic supports of this invention, when turned into end uses, have clean-cut edges, generate little paper dusts, and cause no hanging of waste debris onto the paper sheet and no unseparation of sheets due to incomplete cutting. Therefore, sharpness of cutting or perforating knives becomes less critical, and intervals between the knife blade changes can be extremely extended. Furthermore, when the supports are perforated by a perforating apparatus for making cutting marks formation of trailing or whiskering of woodpulp fibers or polyethylene resin is conspicuously decreased, thus the trouble of miscutting or unseparation of sheet due to erroneous detection by a photocell can be avoided. Moreover, even an especially light weight polyethylene coated paper has a very high stiffness and is fully satisfactory in practice.

The following examples are intended to further illustrate the invention, but they are not intended to limit the scope thereof.

In these examples, the cutting property of supports when cut by a cutter is determined as follows: A photographic polyethylene coated paper roll on which emulsions are applied is printed and developed and in turn cut by Autocutter PKII manufactured by Copal K.K., Japan. Cleanness of cut edges, namely, degree of trailing or whiskering of fibers thereof is judged by naked eye and graded to 1 through 10, wherein the least whiskering or trailing is graded as 1 and the worst as 10. It was found that this cutting property testing results simulate successfully those with a commercially-run apparatus of making cutting marks.

Stiffness of photographic polyethylene coated papers is measured according to JISP8143 and freeness of the woodpulp is measured by Canadian Freeness Tester according to JISP8121.

EXAMPLE 1

A woodpulp slurry consisting of 40 parts by weight of LBSP and 60 parts by weight of LBKP was beaten so that 10% of the woodpulp fibers are retained by the first wire sieve cloth having sieve opening of 710 μm and 40% by the second wire sieve cloth having sieve opening of 350 μm. This fractionation test was in accordance with JISP8207. The thus beaten woodpulp was called pulp 1. A paper was made from a furnish consisting of pulp 1, 0.8% and 2% by weight based on the pulp of alkylketene dimer (solid) as a sizing agent and STARGUM A-15 (solid) which is manufactured by Seiko K.K. Japan, and composed mainly of polyacrylamide as a strength reinforcing agent respectively. The paper thus made was called paper 1. Similarly, paper 2 was made from a furnish consisting of pulp 1, the same sizing agent, and strength reinforcing agent as in paper 1 in an amount of 1.05% and 2% by weight based on the pulp, respectively. Furthermore, paper 3 was made from a furnish consisting of pulp 1, the same sizing agent and strength reinforcing agent as in paper 1 in an amount of 1.54% and 2% by weight based on the pulp, respectively. Both surfaces of these papers 1–3 were extrusion-coated with a polyethylene resin comprising 30 parts by weight of a low-density polyethylene (LDPE) having a density of 0.92 and 70 parts by weight of a high-density polyethylene (HDPE) having a density of 0.96 in a thickness of 30 μm. The thus obtained polyethylene coated papers were applied with a silver halide photographic emulsion and were subjected to automatic printing and developing treatments. These polyethylene coated papers made from papers 1, 2 and 3 were called samples 1, 2 and 3, respectively. Grades of whiskering or trailing of fibers at cut edges when cut by a cutter are shown in Table 1. Similar results were obtained when the samples were perforated by a perforating machine for making cutting marks.

TABLE 1

| Sample No. | Strength reinforcing agent/Sizing agent (Solid weight ratio) | Grade of whiskering or trailing of fibers at cut edge |
|---|---|---|
| 1 | 2.5 | 5.5 |
| 2 | 1.9 | 7.5 |
| 3 | 1.3 | 10 |

It is clear from Table 1 that whiskering or trailing of fibers at cut edges increases with decrease in the solid weight ratio of the strength reinforcing agent to the sizing agent.

EXAMPLE 2

When a rosin size was substituted for the alkylketene dimer as a sizing agent in sample 1 of Example 1, chemicals such as developing solution highly penetrated into the paper from its edge and hence this was found in compatible as a photographic support. Furthermore, sodium stearate was substituted for the alkylketene dimer in sample 1 to obtain sample 4. Additionally, STARGUM A-15 in sample 1 of Example 1 was replaced with MEYPROIDGUM 7700 mainly composed of galactomannan and manufactured by Meyhall Chemical A.G. to obtain sample 5. Grades of whiskering or trailing of fibers at cut edges when cut by a cutter are shown in Table 2.

TABLE 2

| Sample No. 1 | Sizing agent | Strength reinforcing agent | Grade of whiskering or trailing of fibers at cut edges |
|---|---|---|---|
| 1 | Alkylketene dimer | Polyacrylamide | 5.5 |
| 4 | Sodium stearate | Polyacrylamide | 6 |
| 5 | Alkylketene dimer | Galactomannan | 6.5 |

EXAMPLE 3

A woodpulp slurry having the same composition as used in Example 1 was beaten so that no fiber was retained by the first wire sieve cloth having a sieve opening of 710 μm and 30% was retained by the second wire sieve cloth having a sieve opening of 350 μm. The fractionation test was in accordance with JISP8207. The thus beaten pulp was called pulp 2. Paper 4 was prepared in the same manner as paper 1 in Example 1 by substituting pulp 2 for pulp 1 in sample 1, in turn sample 6 was prepared by coating polyethylene resin on both sides of paper 4 exactly as sample 1 of Example 1. Grades of whiskering or trailing of fibers when the sample 6 was cut by a cutter is shown in Table 3.

TABLE 3

| Sample No. | Fractionation characteristic: Retained by the first wire sieve cloth (%) | Fractionation characteristic: Retained by the second wire sieve cloth (%) | Grade of trailing or whiskering of fibers at cut edges |
|---|---|---|---|
| 1 | 10 | 40 | 5.5 |
| 6 | 0 | 30 | 3.5 |

It is recognized from Table 3 that whiskering or trailing of fibers at cut edges can be further reduced by reducing longer fiber fractions of the paper furnish.

EXAMPLE 4

Sample 7 was prepared in the same manner as production of sample 6 of Example 3 except that composition of the same LDPE and HDPE as in Example 1 was changed to 50—50 parts by weight from 30–70 parts by weight. Similarly, sample 8 was prepared by coating the polyethylene resin (50—50 composition) used for production of sample 7 on emulsion side of paper 4 in Example 3 and coating the polyethylene resin (30–70 composition) used in sample 6 of Example 3 on back sides of the paper 4. Degrees of whiskering or trailing of fibers at cut edges when cut by a cutter are shown in Table 4.

TABLE 4

| Sample No. | Content of LDPE in the resin layer (% by weight) Back side | Emulsion side | Grade of trailing or whiskering of fibers at cut edges |
|---|---|---|---|
| 1 | 30 | 30 | 5.5 |
| 6 | 30 | 30 | 3.5 |
| 7 | 50 | 50 | 1 |
| 8 | 50 | 30 | 1.5 |

It is recognized from Table 4 that when content of LDPE in polyethylene resin layer is 35–80% by weight, preferably 40–70% by weight, whiskering or trailing of the polyethylene resin at cut edge can be decreased and thus overall cleanness of cut edges can be improved. It is also recognized that resin composition on emulsion side is less critical with regard to the grade of trailing or whiskering as compared with that on back side since emulsion is applied on that side.

EXAMPLE 5

Samples 9 and 10 were produced in the same manner as in Example 4 except that paper 1 was used in place of paper 4. Sample 9 corresponded to sample 7, i.e., having the same 50—50 resin composition on both sides. Sample 10 corresponded sample 8, i.e., having 50—50 resin composition on back side and 30–70 resin composition on emulsion side. Grades of trailing or whiskering of the resin or fibers when cut by a cutter are shown in Table 5.

TABLE 5

| Sample No. | Content of LDPE in the resin layer (% by weight) Back side | Emulsion side | Grade of trailing or whiskering at cut edges |
|---|---|---|---|
| 1 | 30 | 30 | 5.5 |
| 9 | 50 | 50 | 2.5 |
| 10 | 50 | 30 | 3 |

SAMPLE 6

To a pulp slurry having a freeness of 300 ml which consisted of 30 parts by weight of NBKP, 40 parts by weight of NBSP, and 30 parts by weight of LBKP and had such fractionation characteristic that 15% and 40% was retained by the first and the second wire sieve clothes, respectively when fractioned in accordance with JISP8207, were added 1.05% and 2% by weight based on weight of the pulps of alkylketene dimer as a sizing agent and STARGUM A-15 as a strength reinforcing agent, respectively. Papers were formed from this slurry with or without the addition of polyvinyl alcohol fibers which are neither heat-treated nor acetalized and sold under a tradename of FIBRIBOND 341 by Sansho K.K., Japan. Papers containing 10%, 5%, and 0% by weight of FIBRIBOND 341 based on weight of the woodpulp fibers were called papers 5, 6 and 7, respectively. These papers all had a basis weight of 150 g/m$^2$. Papers 5 and 6 were heat-treated at 80° C. until they were dried. Paper 7 was dried under the same conditions. Both sides of each of papers 5–7 were extrusion-coated with a polyethylene resin comprising 50 parts by weight of LDPE having a density of 0.92 and 50 parts by weight of HDPE having a density of 0.96 in a thickness of 30 μm. These polyethylene coated papers using papers 5, 6 and 7 were called samples 11, 12 and 13, respectively.

Similarly, paper 5 was extrusion-coated on both sides with a polyethylene resin; i.e. comprising 30 parts by weight of LDPE having a density of 0.92 and 70 parts by weight of HDPE having a density of 0.96 in a thickness of 30μ. The thus polyethylene coated paper was called sample 14. Grades of trailing or whiskering at cut edges when cut by a cutter and stiffness of each of the samples are shown in Table 6.

TABLE 6

| Sample No. | Polyvinyl alcohol fibers (% based on woodpulp) | Grade of trailing or whiskering of fibers at cut edges | Stiffness (cm$^3$/100) |
|---|---|---|---|
| 11 | 10 | 1 | 210 |
| 12 | 5 | 3.5 | 195 |
| 13 | 0 | 7.0 | 185 |
| 14 | 10 | 3.5 | 213 |

It is recognized that sample 13 had a substantially high stiffness, but formed more wiskering or trailing of fibers as compared with samples 11, 12 and 14.

It is also recognized that with increase in the content of the polyvinyl alcohol fibers, their effect of reducing formation of whiskering or trailing of fibers at cut edges and increasing stiffness is much enhanced.

Furthermore, comparison of sample 11 and sample 14 shows that when content of LDPE was at least 35 parts by weight in 100 parts by weight of polyethylene resin, trailing or whiskering of polyethylene resin decreased. It has also been confirmed that when content of LDPE was at least 80% by weight, trailing or whiskering of polyethylene resin increased.

It has been further confirmed that unless a heat-treatment temperature in preparing samples 11, 12 and 14 is raised to higher than 50° C., more specifically than 60° C., addition of the polyvinyl alcohol fibers brings about little effect.

It has also been confirmed that the polyvinyl alcohol fibers dispersed in water should not be heated before being added to the pulp slurry. When the polyvinyl alcohol fibers dispersed in water and heated to 60° C. or higher, they dissolve in water, their fibrous shape is mostly lost, therefore their favorable effects are lessened significantly since their retention in papers becomes less.

EXAMPLE 7

A woodpulp slurry having a freeness of 300 ml, consisting of 40 parts by weight of LBSP and 60 parts by weight of LBKP and having such fractionation characteristic that 0% was retained by the first wire sieve cloth and 30% by the second wire sieve cloth in accordance with JISP8207 was prepared. To the aforeprepared pulp slurry 10% of FIBRIBOND 341 based on weight of the woodpulp was added to form paper 8 therefrom. Similarly, paper 9 was prepared from same slurry but without addition of FIBRIBOND 341. The papers 8 and 9 were coated with polyethylene resin in the same manner as sample 11 of Example 6 to obtain samples 15 and 16, respectively. Grades of trailing or whiskering when cut by a cutter and stiffness of each of the samples are shown in Table 7.

TABLE 7

| Sample No. | Grade of trailing or whiskering | Stiffness (cm$^3$/100) |
|---|---|---|
| 11 | 1 | 210 |
| 15 | 1 | 187 |

TABLE 7-continued

| Sample No. | Grade of trailing or whiskering | Stiffness ($cm^3/100$) |
|---|---|---|
| 16 | 3.5 | 168 |

It is recognized that sample 16 which did not contain FIBRIBOND 341 formed more trailing or whiskering and had much lower stiffness than sample 15 which contained said polyvinyl alcohol fibers.

It is to be noted that sample 11, despite making use of longer woodpulp fibers, resulted in a grade of whiskering or trailing of fibers compared with sample 15 which made use of relatively short woodpulp fibers since said polyvinyl alcohol fibers were used for preparing sample 11. It is naturally understood that since sample 11 had higher stiffness than sample 15, the former is more suitable than the latter for making a light weight polyethylene resin coated paper support for photography.

What is claimed is:

1. A photographic support which comprises a paper made from woodpulp fibers and containing a sizing agent and a strength reinforcing agent, and a polyethylene resin coated thereon, the bone dry weight ratio of said strength reinforcing agent to said sizing agent being 1.8–4.0 to 1 and the amount of the sizing agent being 0.3–10.0% by weight of the woodpulp fibers, wherein said polyethylene resin coated on the back side of the paper contains 35–80% by weight of low-density polyethylene, wherein woodpulp fibers constituting the paper stock have fractionation characteristics in accordance with the fractionation method specified in JISP8207 such that 0% is retained by the first wire sieve cloth having a sieve opening of 710 μm and not more than 35% is retained by the second wire sieve cloth having a sieve opening of 350 μm.

2. A photographic support according to claim 1, wherein the polyethylene resin coated on the back side of the paper contains 40–70% by weight of low-density polyethylene.

3. A photographic support according to claim 1, wherein the basis weight of the paper is at least 170 $g/m^2$.

4. A photographic support according to claim 1, wherein the polyethylene resin coated on the emulsion side of the paper contains 40–70% by weight of low-density polyethylene.

* * * * *